US010047733B2

(12) United States Patent
Lounek et al.

(10) Patent No.: US 10,047,733 B2
(45) Date of Patent: Aug. 14, 2018

(54) CYLINDER BLOCK FOR A COMPRESSOR, IN PARTICULAR SWASH PLATE COMPRESSOR, AND SWASH PLATE COMPRESSOR

(71) Applicant: Valeo Japan Co., Ltd., Kumagaya-shi (JP)

(72) Inventors: Jakub Lounek, Podebrady (CZ); Petr Kolman, Jihlava (CZ)

(73) Assignee: Valeo Japan Co., Ltd., Kumagaya-shi, Saitama (JP)

( * ) Notice: Subject to any disclaimer, the term of this patent is extended or adjusted under 35 U.S.C. 154(b) by 420 days.

(21) Appl. No.: 14/404,189

(22) PCT Filed: May 28, 2013

(86) PCT No.: PCT/JP2013/003349
§ 371 (c)(1),
(2) Date: Nov. 26, 2014

(87) PCT Pub. No.: WO2013/179642
PCT Pub. Date: Dec. 5, 2013

(65) Prior Publication Data

US 2015/0135943 A1 May 21, 2015

(30) Foreign Application Priority Data

May 28, 2012 (EP) ..... 12004110

(51) Int. Cl.
*F04B 1/12* (2006.01)
*F04B 1/14* (2006.01)
(Continued)

(52) U.S. Cl.
CPC ..... *F04B 1/143* (2013.01); *F04B 1/128* (2013.01); *F04B 1/148* (2013.01);
(Continued)

(58) Field of Classification Search
CPC .. F04B 27/1018; F04B 27/10; F04B 27/1045; F04B 27/0834; F04B 1/148; F04B 1/128; F04B 1/143
See application file for complete search history.

(56) References Cited

U.S. PATENT DOCUMENTS 4,929,157 A * 5/1990 Steele ..... F04B 27/1036 417/312

FOREIGN PATENT DOCUMENTS

DE 195 45 781 A1 6/1996
EP 0 853 199 A2 7/1998
(Continued)

OTHER PUBLICATIONS

International Search Report for Application No. PCT/JP2013/003349 dated Jul. 12, 2013, 3 pages.
(Continued)

*Primary Examiner* — F. Daniel Lopez
*Assistant Examiner* — Abiy Teka
(74) *Attorney, Agent, or Firm* — Howard & Howard Attorneys PLLC

(57) ABSTRACT

A cylinder block (1) for a compressor has a central opening (3) for accommodating a drive shaft of a drive unit and defines a central axis of the cylinder block (1) with a plurality of cylinder bores (2) arranged around the central opening and each of the cylinder bores (2) adapted for accommodating a piston (14).The cylinder block (1) also has at least one stop (10) on a drive side of the cylinder block (1) with the stop (10) arranged within a triangular area which is delimited by the central opening (3) and the two adjacent cylinder bores (2).

18 Claims, 3 Drawing Sheets

(51) Int. Cl.
*F04B 27/08* (2006.01)
*F04B 27/10* (2006.01)
*F04B 39/12* (2006.01)

(52) U.S. Cl.
CPC ..... *F04B 27/0834* (2013.01); *F04B 27/1054* (2013.01); *F04B 39/122* (2013.01)

(56) References Cited

FOREIGN PATENT DOCUMENTS

| | | |
|---|---|---|
| EP | 0 896 854 A1 | 2/1999 |
| EP | 1 079 109 A2 | 2/2001 |

OTHER PUBLICATIONS

English language abstract and machine-assisted English translation for DE 195 45 781 extracted from espacenet.com database on Dec. 11, 2014, 19 pages.

* cited by examiner

[Fig. 1]
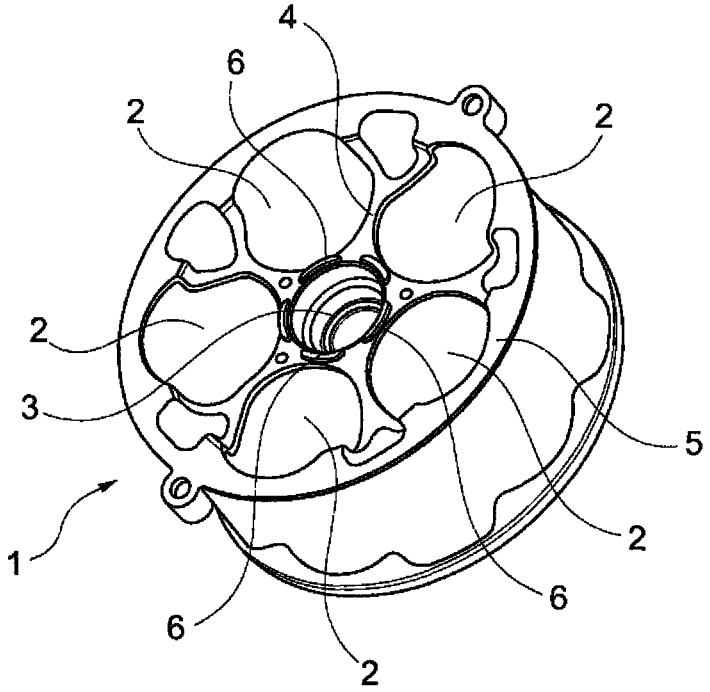
[Fig. 2]
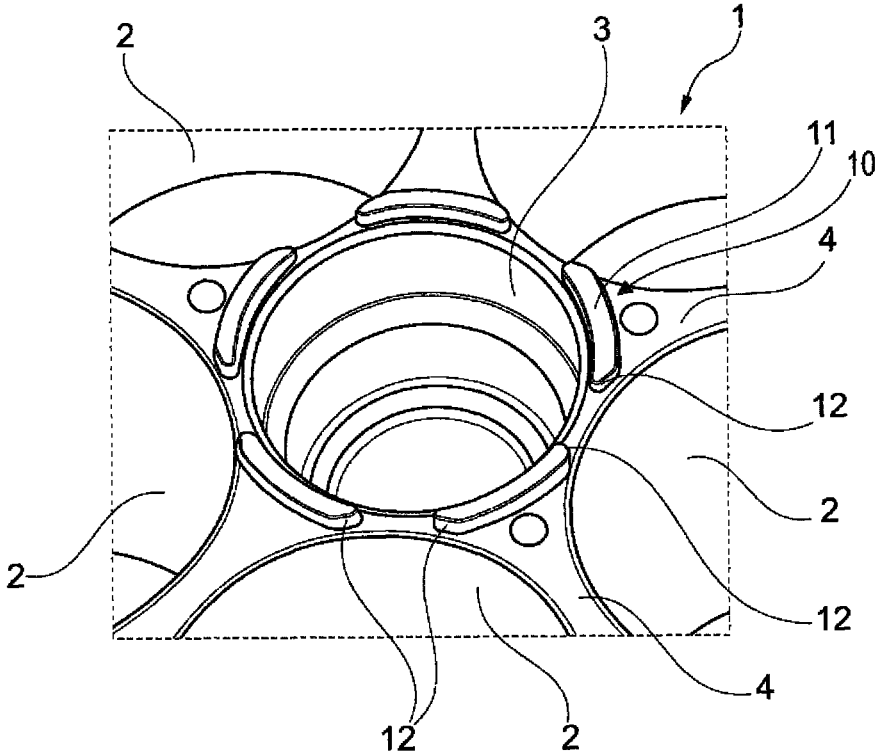

[Fig. 3]
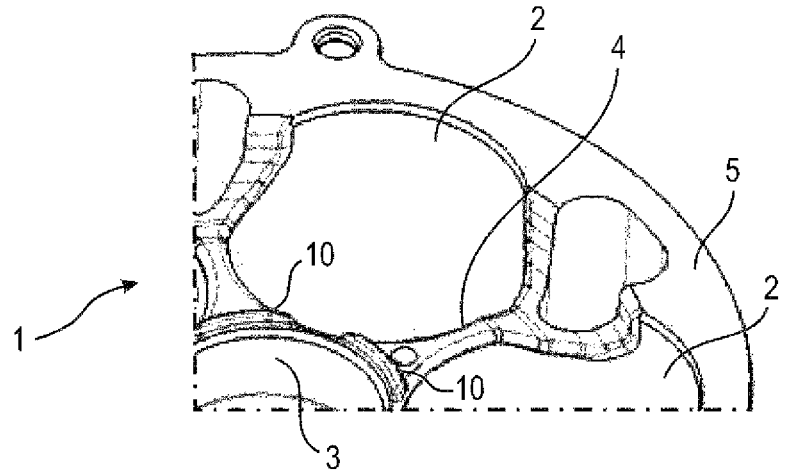
[Fig. 4]
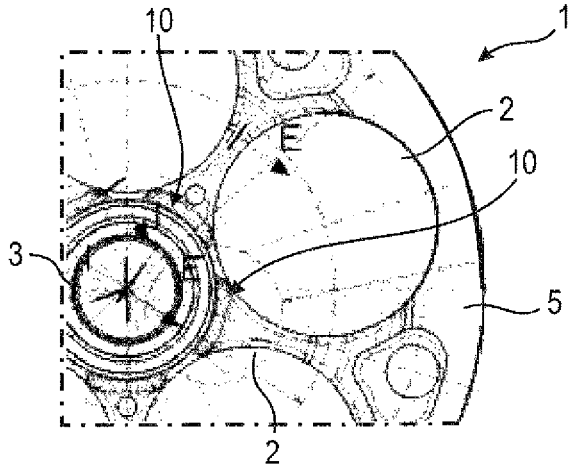
[Fig. 5]
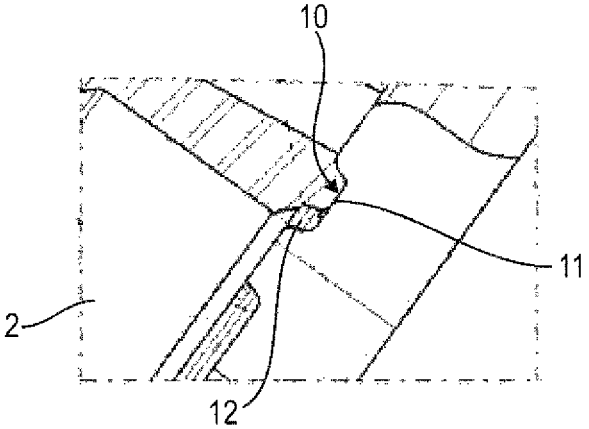

[Fig. 6]
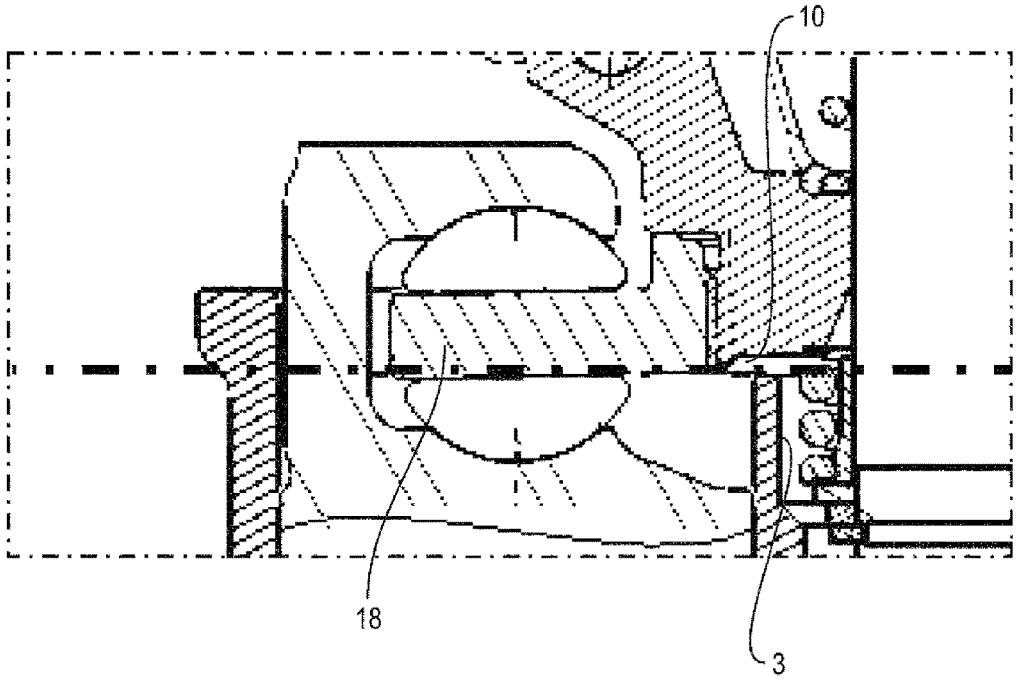
[Fig. 7]
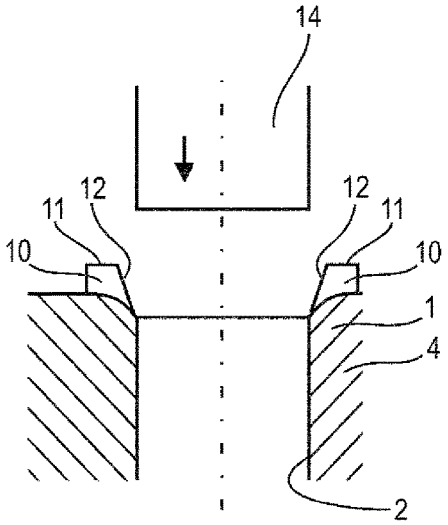

CYLINDER BLOCK FOR A COMPRESSOR, IN PARTICULAR SWASH PLATE COMPRESSOR, AND SWASH PLATE COMPRESSOR

RELATED APPLICATIONS

This application is the National Stage of International Patent Application No. PCT/JP2013/003349, filed on May 28, 2013, which claims priority to all the advantages of European Patent Application No. EP 12004110.8, filed on May 28, 2012, the content of which is incorporated herein by reference.

BACKGROUND ART

The invention relates to a cylinder block for a compressor, having a central opening for accommodating a drive shaft of a drive unit and defining a central axis of the cylinder block, a plurality of cylinder bores arranged around the central opening and adapted for accommodating a piston each, and at least one stop on a drive side of the cylinder block. The invention further relates to a swash plate compressor comprising such cylinder block and further a drive unit comprising a swash plate and extending into the central opening of the cylinder block.

Such compressor can be used for compressing a refrigerant which is used in an air-conditioning system for vehicles. The swash plate is arranged with a variable inclination with respect to a drive shaft which can be coupled to the vehicle motor. The swash plate is connected to each piston via a pair of shoes arranged between the end portion of the piston and the swash plate. Each shoe slides onto a ring portion of the swash plate so that each of the piston reciprocates when the swash plate is driven. An example of such compressor can be found in EP 0 853 199 A2.

The ring portion of the swash plate on which the shoes slide, is provided with a particular coating. Such a swash plate is mounted onto the drive shaft, and several pistons are hanged on those coated portions of the swash plate via pairs of the shoes respectively. The swash plate, the shoes, the pistons, and the shaft define the main part of the drive unit.

Then the drive unit is inserted into the cylinder block, the pistons are meanwhile inserted into the respective cylinder bores of the cylinder block, whereas the drive shaft is inserted in the central opening of the cylinder block. During the mounting process of the drive unit into the cylinder block, special care must be exercised for preventing that the coating applied to the ring portion of the swash plate is damaged.

Those portions of the swash plate which are used for driving the pistons are provided with a particular coating. During mounting of the compressor, special care must be exercised for preventing that the coating is damaged. If no special measure are taken, there is a risk that the shaft is pushed so far into the cylinder block that the swash plate connected to the shaft contacts the cylinder block. This could result in the coating of the swash plate being damaged.

In order to prevent such damages, it is known to use small protruding stops on the drive side of the cylinder block, which is the side which faces the swash plate. These stops are arranged between the central opening and each of the cylinder bores. In other words, each stop is arranged at a radius which runs through the central axis of the respective cylinder bore. When the drive unit with the swash plate is being mounted to the cylinder block, the stops can come into contact with a portion of the swash plate which is arranged radially inward of the coating, thereby preventing that the coated portions can contact the cylinder block and thereby become damaged.

The problem with the known stops is that they are arranged as protruding portions on the cylinder block at a place where the wall thickness is very small. This results in problems when casting the cylinder blocks.

The object of the invention is to improve the known cylinder blocks such that the castability of the cylinder block is improved.

In order to achieve this object, a cylinder block as defined above is characterized in that the stop is arranged within an area which is delimited radially inwardly by the central opening and in a peripheral direction by lines extending from the central axis through the center lines of adjacent cylinder bores. The invention is based on the recognition that the location of the stops can be moved in a peripheral direction as compared to the prior art by approximately half of the angular distance between adjacent cylinder bores. This results in each stop being located in a region of the cylinder block where an increased wall thickness is available for accommodating the stop, while at the same time maintaining the effectiveness of the stop. Choosing a region of the cylinder block with a larger wall thickness as "base" for the stop significantly increases the castability of the cylinder block.

According to a preferred embodiment, the stop is in the form of a curved ridge concentric with the central axis. This design allows forming a stop which is relatively wide without having the risk that it comes into contact with the coating of the swash plate.

Preferably, the stop is arranged close to the central opening. This further reduces the risk of the stop coming into contact with the coating of the swash plate.

If there are some damages of the swash plate by contacting with the cylinder block during the mounting process, it is preferable to do this damage onto the inward portion rather than onto the sliding surface which is located inside the shoes.

According to a preferred embodiment, the stop extends, in a peripheral direction, up to the respective cylinder bore. In this manner, the available space is used in an optimum manner.

Preferably, the opposite ends of the stop are chamfered. This allows using the stops for guiding the pistons into the respective cylinder bores during mounting.

Preferably, the chamfer is arranged with an angle of approximately 15% with respect to a plane which is parallel to the central axis. This angle has proven to be a good compromise for facilitating insertion of the pistons into the cylinder bores. According to a preferred embodiment, a stop is provided between each pair of adjacent cylinder bores. Thus, the number of stops used at the cylinder block is maximized.

The distance between adjacent stops can be approximately half of the length of the stops. This design allows to not provide any stop in a region where the wall thickness between the central opening and the cylinder bore is narrow while at the same time providing sufficient abutment surface for the swash plate.

According to a preferred embodiment of the invention, the stop ends at a level which is below a level defined by the outer edge of the cylinder block. This design results in three different levels of the cylinder block which are useful for inserting the pistons into the respective cylinder bores. A first, uppermost level is defined by the outer edges of the cylinder block which can be used for guiding the pistons at the radially outer side. As the pistons are further advanced towards the cylinder bores, a second level is reached which is defined by the upper surface of the stops, as from which the chamfer at the stops can act on the piston. A third, lower level is defined by the end face of the cylinder block at the drive side, as from which each piston enters into the respective cylinder bore.

The invention further provides a swash plate compressor having a cylinder block as defined above, and a drive unit comprising a swash plate and extending into the central opening of the cylinder block. Regarding the advantages of such swash plate compressor, reference is made to the above comments.

The invention will now be described with reference to a preferred embodiment which is shown in the enclosed drawings. In the drawings:

BRIEF DESCRIPTION OF DRAWINGS

FIG. 1 shows in a perspective view a cylinder block according to the prior art, FIG. 2 in a perspective view a center portion of a cylinder block according to the invention, FIG. 3 a perspective view of a cylinder block according to the invention, FIG. 4 a top view of the cylinder block according to the invention, FIG. 5 a cross section through a stop of a cylinder block according to the invention, FIG. 6 a cross section through a swash plate compressor according to the invention during mounting, and FIG. 7 a schematic view of the process of mounting a piston to the cylinder block.

In FIG. 1, a cylinder block 1 for a swash plate compressor is shown. It is a generally cylindrical part made from cast metal, for example an aluminum alloy, and comprises in this embodiment five cylinder bores 2 which are arranged concentrically around a central opening 3 which is provided for accommodating a drive shaft. Central opening 3 defines a central axis of cylinder block 1.

The end face of cylinder block 1 which is visible in FIG. 1 is facing the swash plate and is therefore designated as "drive side". The level at which the cylinder bores 2 end is referred to as end face 4. It is the same level at which central opening 3 ends. The circumferential portion 5 of cylinder block 1 protrudes over end face 4. In other words, end face 4 is recessed as compared to the uppermost level defined by cylinder block 1.

On end face 4, a plurality of stops 6 is provided which are formed as small protruding ridges formed integrally with cylinder block 1. Each stop 6 is arranged at the place where the wall thickness between central opening 3 and the respective cylinder bore 2 is minimal. In other words, each stop is arranged at a position which lies between the central axis of cylinder block 1 and the central axis of the respective cylinder bore 2.

The cylinder block according to the invention will now be described with reference to FIGS. 2 to 5. For elements known from FIG. 1, the same reference numerals are being used, and reference is made to the above comments.

Cylinder block 1 according to the invention uses stops 10 which are arranged at a position where the wall thickness of the cylinder block 1, near the central opening 3, is larger as compared to the prior art design.

As can be seen in FIGS. 2 to 4, each stop 10 according to the invention is provided in the generally triangular portion which is delimited by two adjacent cylinder bores 2 and the central opening 3.

Such a triangular area allows the casting of the cylinder block. Such a triangular area allows a molding process of the cylinder block. This area allows also to create stops whose the width is enough for the molding process.

In other words, each stop 10 is arranged within an area which is delimited radially inwardly by central opening 3, and laterally by lines extending from the central opening 3 to peripheral edges of two adjacent cylinder bores 2.

Thus, the thickness of the stop is bigger than the thickness of the separating wall located between the central opening and a cylinder bore.

The portion of end face 4 where the wall thickness between central opening 3 and the respective cylinder bore 2 is minimal, is kept free from stop 10. The distance between adjacent stops 10 in the region of the small wall thickness is approximately half of the length of each stop 10 in a peripheral direction.

Each stop 10 is formed as a ridge integrally with cylinder block 1, and extending in a curved manner immediately adjacent to central opening 3 concentric with the central axis.

Each stop 10 has two opposite ends 12, which can be also called lateral ends, which are formed as a chamfer. As can be seen in FIG. 5, each chamfer is inclined by an angle of 15 degrees with respect to a plane which is parallel to the central axis. So, two chamfers 12 are useful for guiding one piston 14 of the compressor into the respective cylinder bore. This can be seen in FIG. 7.

In FIG. 6, the function of stops 10 can be seen. During a mounting process, the outer end 11 of each stop 10 can come into contact with the radial inner portions of a swash plate 16 such that the radially outer portions 18 used for driving pistons 14 is kept in a distance from end face 4 of cylinder block 1, thereby preventing any damage.

The invention claimed is:

1. A cylinder block (1) for a compressor having a central opening (3) for accommodating a drive shaft of a drive unit and defining a central axis of the cylinder block (1), the cylinder block (1) comprising a plurality of cylinder bores (2) arranged around the central opening (3) and with each of the cylinder bores (2) adapted for accommodating a piston (14), and at least one stop (10) on a drive side of the cylinder block (1), wherein the stop (10) is completely arranged within a triangular area which is delimited by the central opening (3) and the two adjacent cylinder bores (2), wherein the triangular area is delimited radially and inwardly by the central opening (3) and laterally by lines extending from the central axis through the center lines of two adjacent cylinder bores (2), and wherein a thickness of said stop is greater than a distance between said central opening (3) and said cylinder bores (2).

2. The cylinder block (1) of claim 1 wherein the stop (10) is in the form of a curved ridge concentric with the central axis (30).

3. The cylinder block (1) of claim 2 wherein the stop (10) extends, in a peripheral direction, up to the two adjacent cylinder bores (2).

4. The cylinder block (1) of claim 1 wherein the stop (10) is arranged close to the central opening (3).

5. The cylinder block (1) of claim 1 wherein the stop (10) extends, in a peripheral direction, up to the two adjacent cylinder bores (2).

6. The cylinder block (1) of claim 5 wherein the chamfer (12) is arranged with an angle of 15 degrees with respect to a plane which is parallel to the central axis.

7. The cylinder block (1) of claim 6 wherein the distance between adjacent stops (10) is half of the length of the stops (10).

8. The cylinder block (1) of claim 1 wherein opposite ends of the stop (10) are chamfered.

9. The cylinder block (1) of claim 1 wherein a stop (10) is provided between each pair of adjacent cylinder bores (2).

10. The cylinder block (1) of claim 1 wherein the outer end (11) of the stop (10) ends at a level which is below a level defined by the outer edge (5) of the cylinder block.

11. A swash plate compressor having a cylinder block (1) as defined in claim 1, and a drive unit comprising a swash plate (16) and extending into the central opening (3) of the cylinder block (1).

12. The cylinder block (1) of claim 1 wherein the stop (10) is arranged close to the central opening (3).

13. The cylinder block (1) of claim 1 wherein the stop (10) extends, in a peripheral direction, up to the two adjacent cylinder bores (2).

14. The cylinder block (1) of claim 1 wherein opposite ends of the stop (10) are chamfered.

15. The cylinder block (1) of claim 1 wherein the cylinder block (1) is casted such that the stop (10) is formed integrally with the cylinder block (1).

16. A cylinder block (1) for a compressor having a central opening (3) for accommodating a drive shaft of a drive unit and defining a central axis of the cylinder block (1), the cylinder block (1) comprising a plurality of cylinder bores (2) arranged around the central opening (3) and with each of the cylinder bores (2) adapted for accommodating a piston (14), and at least one stop (10) on a drive side of the cylinder block (1), wherein the stop (10) is completely arranged within a triangular area which is delimited by the central opening (3) and the two adjacent cylinder bores (2), wherein the triangular area is delimited radially and inwardly by the central opening (3) and laterally by lines extending from the central axis through the center lines of two adjacent cylinder bores (2), wherein the stop (10) is in the form of a curved ridge concentric with the central axis (30), and wherein the stop (10) extends, in a peripheral direction, up to the two adjacent cylinder bores (2).

17. The cylinder block (1) of claim 16 wherein opposite ends of the stop (10) are chamfered.

18. The cylinder block (1) of claim 16 wherein the cylinder block (1) is casted such that the stop (10) is formed integrally with the cylinder block (1).

* * * * *